US011415360B1

(12) United States Patent
Wantland et al.

(10) Patent No.: US 11,415,360 B1
(45) Date of Patent: Aug. 16, 2022

(54) DOOR-IN-DOOR REFRIGERATOR WITH SLIDING DOOR

(71) Applicant: Haier US Appliance Solutions, Inc., Wilmington, DE (US)

(72) Inventors: Louis A. Wantland, Louisville, KY (US); Daniel Allen, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/166,131

(22) Filed: Feb. 3, 2021

(51) Int. Cl.
*F25D 23/02* (2006.01)
*E05F 5/02* (2006.01)

(52) U.S. Cl.
CPC ..... *F25D 23/021* (2013.01); *E05F 5/02* (2013.01); *F25D 23/025* (2013.01); *E05Y 2900/306* (2013.01); *F25D 2323/023* (2013.01); *F25D 2323/024* (2013.01)

(58) Field of Classification Search
CPC ..... F25D 23/021; F25D 23/25; F25D 23/028; F25D 2323/023; E05F 5/02; E05Y 2900/306
See application file for complete search history.

(56) References Cited

U.S. PATENT DOCUMENTS 2,463,250 A * 3/1949 Curtiss, Jr. ..... F25D 23/021 62/441
3,851,939 A * 12/1974 Benasutti ..... F25D 23/021 312/139.2
4,046,438 A * 9/1977 Benasutti ..... F25D 23/021 312/139.2
8,484,895 B2 * 7/2013 Kuhnmuench ..... E05D 15/48 49/164
8,752,918 B2 6/2014 Kang
9,389,011 B2 7/2016 Kim
9,915,470 B2 * 3/2018 Kim ..... A47B 88/477
2015/0241113 A1 * 8/2015 Kim ..... F25D 23/028 312/405
2015/0253060 A1 * 9/2015 Borise ..... F25D 23/021 312/405
2017/0082351 A1 * 3/2017 Jung ..... F25D 25/025
2018/0187949 A1 * 7/2018 Wu ..... E05D 15/0621
2018/0195791 A1 * 7/2018 Wu ..... E05D 3/14
2019/0120542 A1 * 4/2019 Kim ..... F25D 23/025
2020/0284498 A1 * 9/2020 Claass ..... F25D 23/04

FOREIGN PATENT DOCUMENTS

CN 202582014 U 12/2012
CN 103471311 B 12/2015
KR 20110080277 A 7/2011

* cited by examiner

*Primary Examiner* — Daniel J Rohrhoff
(74) *Attorney, Agent, or Firm* — Dority & Manning, P.A.

(57) ABSTRACT

A door assembly for an appliance includes a frame door defining a vertical direction, a lateral direction, and a transverse direction, the frame door being attached to the cabinet and movable between an open position and a closed position to permit selective access to the cavity; an outer door slidably connected to the frame door, the outer door being slidable relative to the frame door between an open position and a closed position; and a slide assembly connecting the outer door to the frame door.

17 Claims, 7 Drawing Sheets

DOOR-IN-DOOR REFRIGERATOR WITH SLIDING DOOR

FIELD OF THE INVENTION

The present subject matter relates generally to refrigerator appliances, and more particularly to refrigerator appliances having one or more doors.

BACKGROUND OF THE INVENTION

Refrigerator appliances generally include a cabinet that defines a food storage chamber. In addition, refrigerator appliances also generally include a door rotatably hinged to the cabinet to permit selective access to food items stored in the food storage chamber. Certain refrigerator appliances, commonly referred to as door-in-door refrigerator appliances, may also include an outer door rotatably hinged to the inner door to permit selective access to the food storage chamber or, alternatively, a food storage chamber positioned between the inner and outer doors. In addition, door-in-door appliances may also include a gasket positioned on the outer door. Thus, when the outer door is in the closed position, the gasket seals against the inner door to enclose the food storage chamber.

Door-in-door refrigerator appliances conventionally operate such that each of the outer door and inner door are rotatable, sometimes about the same axis of rotation. Thus, a locking mechanism may be required to latch the outer door to the inner door. In certain conventional designs, a latch on the outer door engages a catch on the inner door to lock the outer door to the inner door to allow a user to selectively open either the outer door or the inner door. However, certain drawbacks exist with these conventional designs. For instance, the locking mechanism may be susceptible to malfunction, requiring expensive replacement or repair. Further, a user must operate the latch each time he or she wishes to access a particular storage chamber.

Accordingly, a refrigerator appliance that obviates one or more of the above-mentioned drawbacks would be useful. In particular, a refrigerator appliance having a door-in-door configuration with features for improving durability, increasing ease of operation, or otherwise extending the usable life of the appliance (e.g., while eliminating the need for a latch or locking mechanism) would be especially useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a door assembly for an appliance is provided. The appliance may include a cabinet defining a cavity. The door assembly may include a frame door defining a vertical direction, a lateral direction, and a transverse direction, the frame door being attached to the cabinet and movable between an open position and a closed position to permit selective access to the cavity; an outer door slidably connected to the frame door, the outer door being slidable relative to the frame door between an open position and a closed position; and a slide assembly connecting the outer door to the frame door. The slide assembly may include a first slide rail extending from the frame door, and a second slide rail extending from the outer door and in sliding communication with the first slide rail.

In another exemplary aspect of the present disclosure, a refrigerator appliance is disclosed defining a vertical direction, a lateral direction, and a transverse direction. The refrigerator appliance may include a cabinet defining a cavity; and a door assembly movably coupled to the cabinet. The door assembly may include a frame door attached to the cabinet, the frame door being movable between an open position and a closed position to permit selective access to the cavity; an outer door slidably connected to the frame door, the inner door being slidable between an open position and a closed position; and a slide assembly connecting the outer door to the frame door. The slide assembly may include a first slide rail connected to the frame door, and a second slide rail connected to the outer door and in sliding communication with the first slide rail.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
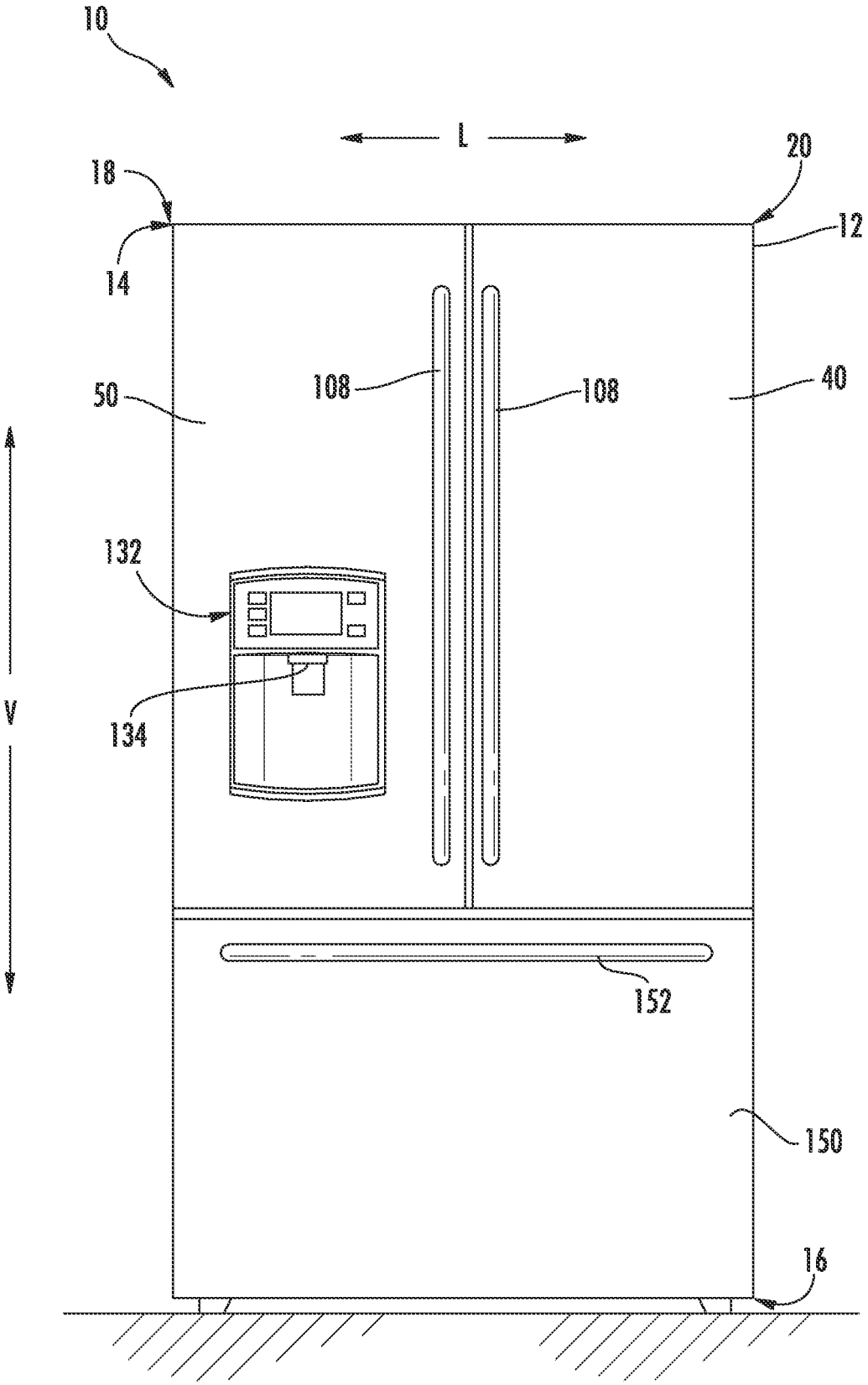
FIG. 1 provides a front elevation view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component or position from another and are not intended to signify an absolute location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

Figure 2:
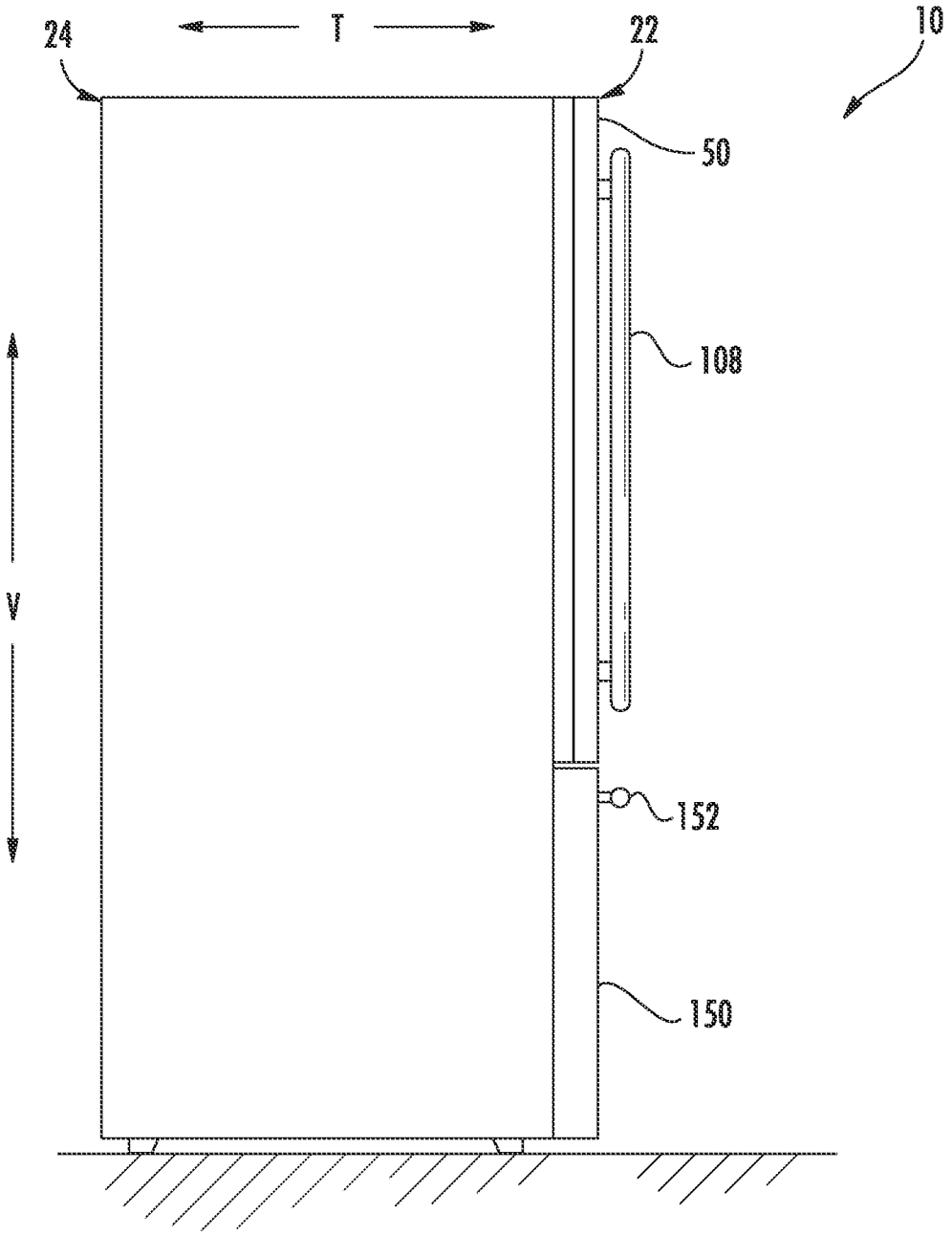
FIG. 2 provides a side view of the exemplary refrigerator appliance of FIG. 1.
Figure 3:
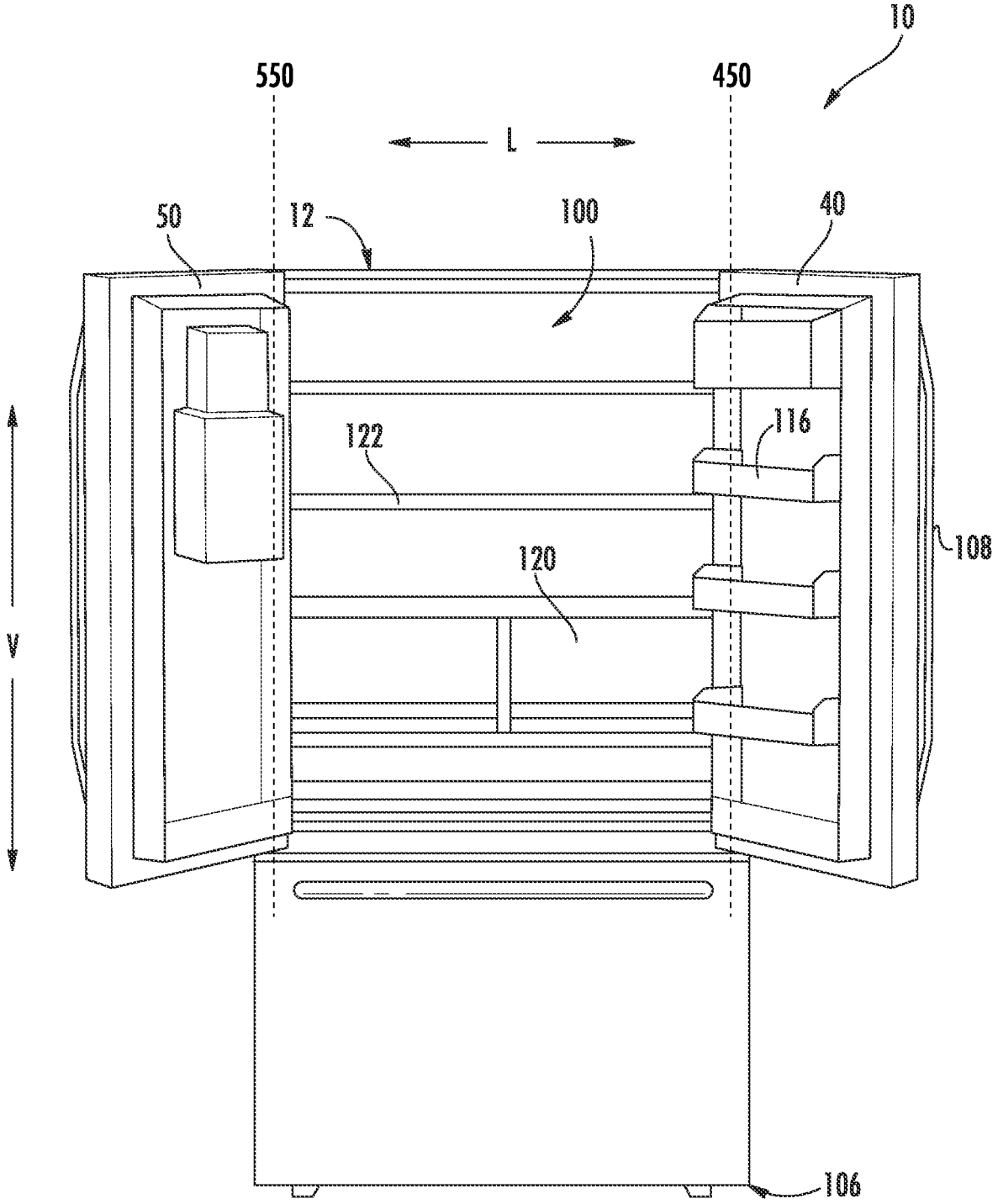
FIG. 3 provides a perspective view of the exemplary refrigerator appliance of FIG. 1.

Referring now to FIGS. 1 through 3, a refrigerator appliance 10 according to an embodiment of the present subject matter defines a vertical direction V, a lateral direction L, and a transverse direction T (see, e.g., FIG. 2), each mutually perpendicular to one another. As may be seen, the refrigerator appliance 10 includes a housing or cabinet 12 that extends between a top 14 and a bottom 16 along the vertical direction V, between a left side 18 and a right side 20 along the lateral direction L, and between a front side 22 and a rear side 24 along the transverse direction T (see, e.g., FIG. 2).

The cabinet 12 generally defines a food storage chamber 100 (FIG. 3) for receipt of food items for storage. In particular, the food storage chamber 100 is positioned at or adjacent the top 14 of the cabinet 12. It should be appreciated, however, that the food storage chamber 100 may be positioned at any suitable location within the refrigerator appliance 10. For example, in one embodiment, the food storage chamber 100 may extend from top 14 to bottom 16 along the vertical direction V.

The refrigerator appliance 10 may include one or more refrigerator doors 40, 50 rotatably mounted to the cabinet, e.g., such that the refrigerator doors 40, 50 permit selective access to the food storage chamber 100. As shown, in some embodiments, the refrigerator doors 40, 50 include a right refrigerator door (e.g., first side door) 40 and a left refrigerator door (e.g., second side door) 50. The right refrigerator door 40 may be rotatably mounted to the cabinet 12 at the right side 20 of the cabinet 12. The left refrigerator door 50 may be rotatably mounted to the left side 18 of the cabinet 12. The right refrigerator door 40 may pivot about a first pivot axis 450. The left refrigerator door 50 may pivot about a second pivot axis 550. A handle 108 may be positioned on each of the refrigerator doors 40, 50 to facilitate movement of the doors 40, 50 between a fully closed position (FIG. 1) and a fully open position (FIG. 3).

The refrigerator appliance 10 may also include a dispenser assembly 132 for dispensing liquid water and/or ice. The dispenser assembly 132 includes a dispenser 134 which may be positioned on or mounted to an exterior portion of the refrigerator appliance 10, e.g., on the left refrigerator door 50. Additionally or alternatively, the refrigerator appliance 10 may include a freezer drawer 150 arranged below the refrigerator doors 40, 50 for selectively accessing items within a frozen food storage chamber (not shown). The freezer drawer 150 may include a handle 152 that is slidably mounted to the cabinet 12. Accordingly, the freezer drawer 150 may be moved in and out of the frozen food storage chamber (not shown) along the transverse direction T.

As shown in FIG. 3, various storage components may be mounted within the food storage chamber 100 to generally facilitate storage of food items. In certain embodiments, the storage components include bins 116, drawers 120, and shelves 122 that are mounted within the fresh food chamber 100. The bins 116, drawers 120, and shelves 122 are configured for receipt of food items (e.g., beverages and/or solid food items) and may assist with organizing such food items.

Referring now generally to FIGS. 4A through 7, the refrigerator appliance 10 may be configured as a door-in-door refrigerator. In particular, the right refrigerator door 40 may be replaced with a nested door assembly comprising an outer door 102 and a frame door 105. In another embodiment, the left refrigerator door 50 may be replaced with the nested door assembly. In yet another alternative embodiment, both refrigerator doors 40, 50 may be replaced with the nested door assembly.

As shown, outer door 102 may be connected to frame door 105 in a sliding manner. For instance, frame door 105 may also define a vertical direction V, a lateral direction L, and a transverse direction T, each being mutually exclusive from one another. As described above, refrigerator appliance may include right refrigerator door 40 and left refrigerator door 50. Accordingly, right refrigerator door 40 may include a frame door 105 and an outer door 102. Similarly, left refrigerator door 50 may include a frame door 105 and an outer door 102. In some embodiments, only one of right refrigerator door 40 and left refrigerator door 50 includes a frame door 105 and an outer door 102.

Right outer door 102 may be configured to slide in a first direction with respect to right frame door 105. For instance, right outer door 102 may slide predominantly laterally with respect to right frame door 105 when refrigerator appliance 10 is viewed from the front. In other words, during an opening motion, right outer door 102 may translate in a first direction with respect to right frame door 105. As described further below, the first direction may encompass a lateral portion and a transverse portion. Accordingly, right frame door 105 may remain stationary while right outer door 102 translates away from right frame door 105 in the first direction. Similarly, during a closing motion, right outer door 102 may translate toward right frame door 105 in a direction opposite the first direction. Additionally or alternatively, right outer door 102 may remain parallel to right frame door 105 throughout an opening and closing motion. Left outer door 102 may be configured to slide in a second direction with respect to left frame door 105. For instance, left outer door 102 may slide predominantly laterally with respect to left frame door 105 when refrigerator appliance 10 is viewed from the front. In other words, during an opening motion, left outer door 102 may translate in a second direction with respect to left frame door 105. Similar to the first direction, the second direction may encompass a lateral portion and a transverse portion. Accordingly, left frame door 105 may remain stationary while left outer door 102 translates away from left frame door 105 in the second direction. Similarly, during a closing motion, left outer door 102 may translate toward left frame door 105 in a direction opposite the second direction. Additionally or alternatively, right outer door 102 may remain parallel to right frame door 105 throughout an opening and closing motion. In some embodiments, the second direction is different from the first direction. For instance, the first direction may be an equal reflection of the second direction about a plane defined in the vertical V and transverse T directions.

As described above, frame door 105 may be rotatably connected to cabinet 12. Accordingly, outer door 102 may be connected to frame door 105 in a sliding manner. For instance, a slide assembly 200 may be connected between outer door 102 and frame door 105. Slide assembly 200 may be a multi-stage slide. For instance, slide assembly 200 may include a first slide rail 202 connected to frame door 105, a second slide rail 204 connected to outer door 102, and a third slide rail 206 connected between first slide rail 202 and second slide rail 204. It should be noted that the number of stages included in slide assembly 200 is not limited, and may include more or fewer stages as applications warrant, as would be understood. First slide rail 202 may extend from frame door 105. First slide rail 202 may be an elongated metal piece capable of allowing another elongated metal piece (e.g., second rail 204, described below) to slide with respect to first slide rail 202. Additionally or alternatively, first slide rail 202 may be defined as an interior lateral rail (e.g., proximate cabinet 12). First slide rail 202 may have any suitable shape allowing second slide rail 204 to slide with respect thereto.

The second slide rail 204 may extend from outer door 102. Second slide rail 204 may be in sliding communication with first slide rail 202. For instance, second slide rail 204 may be colinear with first slide rail 202. In some embodiments, second slide rail 204 may be accepted within first slide rail 202. In other words, second slide rail 204 and first slide rail 202 may form a nested coupling. Additionally or alternatively, second slide rail 204 may be defined as an exterior lateral rail (e.g., distal cabinet 12). Additionally or alternatively, a third slide rail 206 may be included in the slide assembly. For instance, third slide rail 206 may be connected between first slide rail 202 and second slide rail 204. For example, third slide rail may be a conventional drawer slide rail. Thus, third slide rail 206 may be nested between first slide rail 202 and second slide rail 204, such that slide assembly 200 forms a three-bar-slide assembly. In some embodiments, each of the first, second, and third slide rails 202, 204, 206 may comprise a plurality of tracks and a plurality of ball bearings. It should be appreciated that drawer slides are well known in the art, and accordingly a detailed explanation thereof will be foregone for brevity.

Figures 6A, 6B:
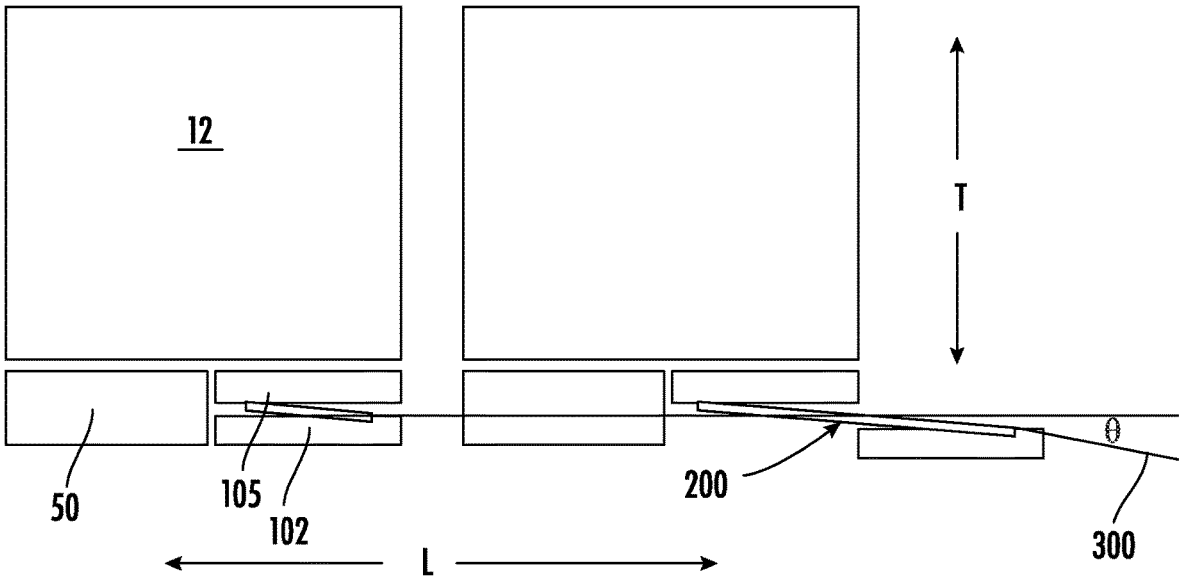
FIG. 6A provides a top view of the exemplary refrigerator appliance of FIG. 1 with the outer door in a closed position.
FIG. 6B provides a top view of the exemplary refrigerator appliance of FIG. 1 with the outer door in an open position.
Figure 7:
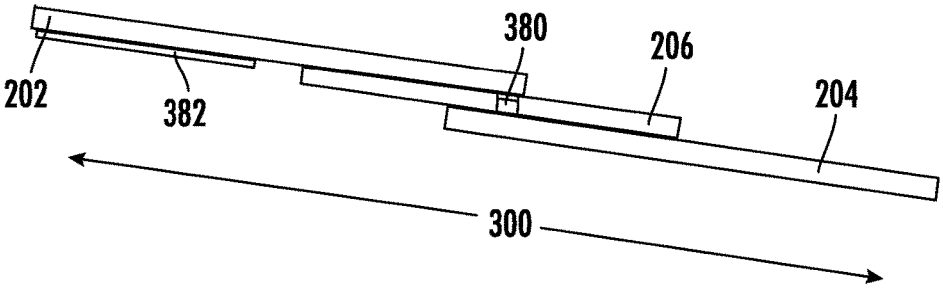
FIG. 7 provides a top view of a slide assembly of the exemplary refrigerator appliance of FIG. 1

Referring briefly to FIGS. 6A and 6B, slide assembly 200 may extend at a predetermined angle Θ with respect to the lateral direction L. The predetermined angle Θ may be sufficient to restrict or eliminate scrubbing of a gasket provided between outer door 102 and frame door 105. The predetermined angle Θ may be about 20 degrees, 15 degrees, 10 degrees. However, it should be understood that any suitable angle may be used. Accordingly, when outer door 102 is moved from the closed position to the open position, outer door 102 may translate in the lateral direction L and the transverse direction T. For example, slide assembly 200 may be orientated such that a sliding motion occurs along a sliding axis 300. When a user wishes to move outer door 102 from the closed position to the open position, the user may pull handle 108 predominantly in the lateral direction L (i.e., in a direction along the sliding axis 300). Thus, frame door 105 remains closed while outer door 102 slides to the open position. Accordingly, outer door may be displaced in the lateral direction L as well as the transverse direction T, away from cabinet 12. It should be appreciated that as used herein, terms of approximation, such as "approximately," "substantially," or "about," refer to being within a ten percent margin of error.

Additionally or alternatively, slide assembly 200 may take any suitable shape. For instance, slide assembly 200 may have a curved shape. In detail, first slide rail 202 may be curved in the transverse direction T. The curve of first slide 202 may be convex or concave, depending on particular applications. Accordingly, second slide rail 204 may have a curve that is equivalent to the curve of first slide rail 202. Second slide rail 204 may slide along a curved path with respect to first slide rail 202, thus allowing outer door 102 to slide along a curved path with respect to frame door 105. In some embodiments, slide assembly 200 may consist of a roller and guide rail assembly. For example, a guide rail may be attached to frame door 105 and one or more rollers may be attached to outer door 102. Accordingly, the rollers on outer door 102 may roll along the guide rail on frame door 105 when outer door 102 is moved between the closed position and the open position.

A plurality of slide assemblies 200 may be provided. For instance, a first slide assembly 200 may be provided at or near a top of frame door 105. Additionally or alternatively, a second slide assembly 200 may be provided at or near a bottom of frame door 105. First slide assembly and second slide assembly 200 may be parallel to each other. Accordingly, outer door 102 may be fully supported with respect to frame door 105 and may open in a smooth, unencumbered fashion. It should be noted that any suitable number of slide assemblies 200 may be used according to specific embodiments such that outer door 102 is supported with respect to frame door 105. Second slide assembly 200 (and, in turn, any additional slide assemblies) may be constructed similar to slide assembly 200 discussed above, and as such, as detailed explanation thereof will be foregone for brevity.

Figure 4:
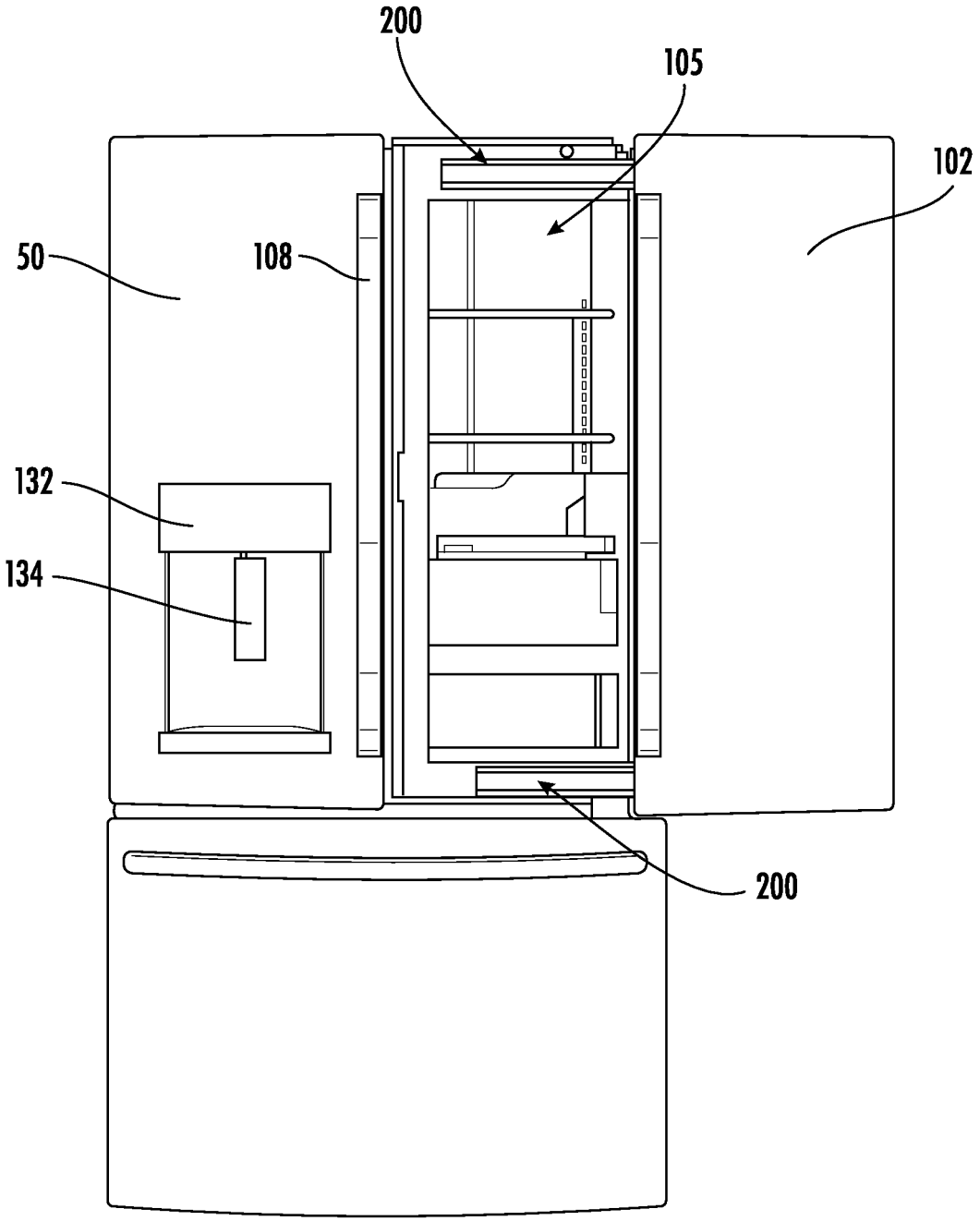
FIG. 4 provides a front view of the exemplary refrigerator appliance of FIG. 1 with a first outer door in an open position.
Figure 5:
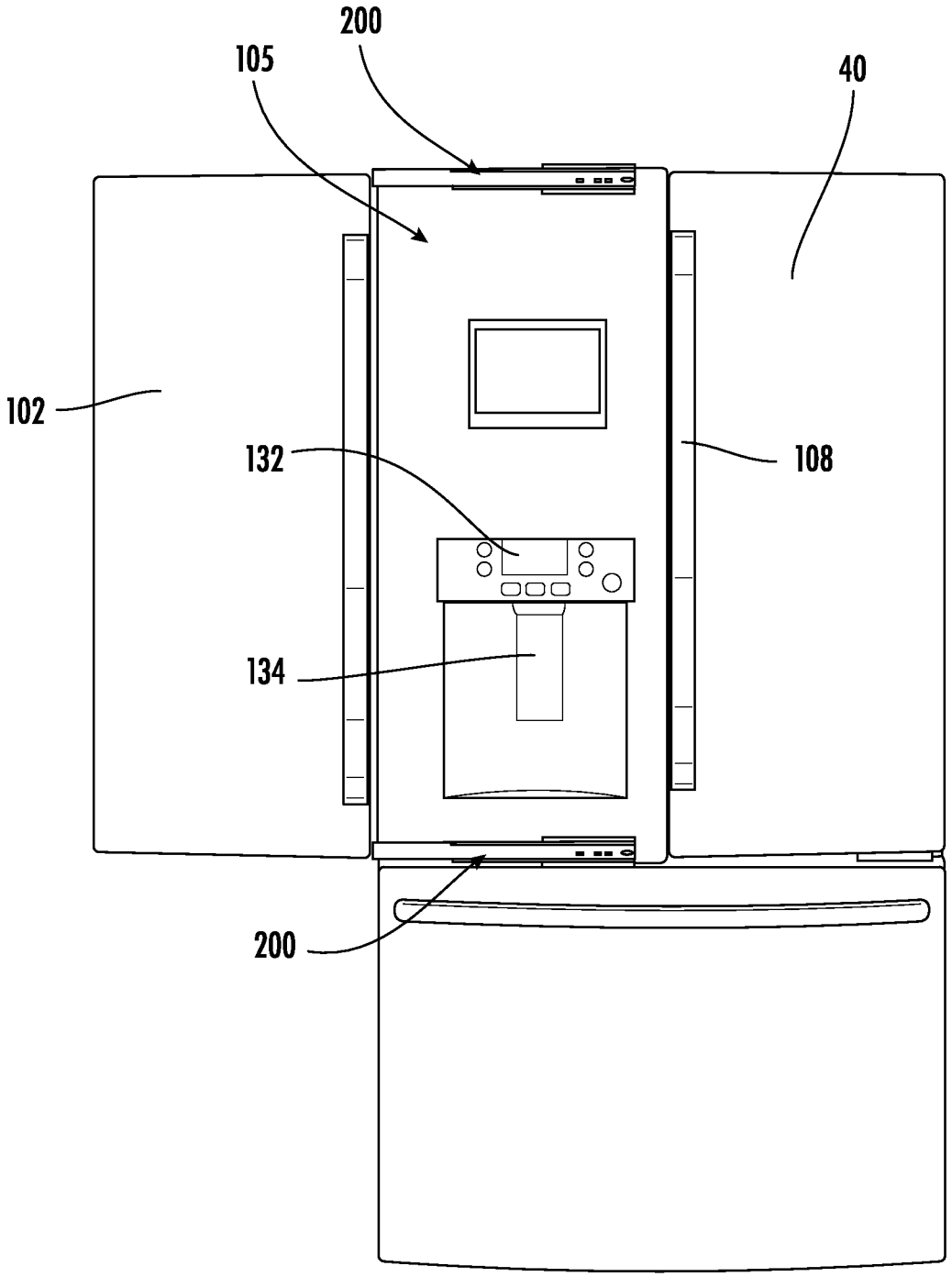
FIG. 5 provides a front view of the exemplary refrigerator appliance of FIG. 1 with a second outer door in an open position.

Slide assembly 200 may further include a striker 380 which extends from second slide rail 204, e.g., away from outer door 102 along the transverse direction V. In addition, slide assembly 200 may include a soft close mechanism 382 which is mounted to first slide rail 202 and is configured for engaging striker 380 when outer door 102 is moved toward the closed position. However, it should be appreciated that according to alternative embodiments, soft close mechanism 382 could be mounted to second slide rail 204 and striker 380 could be affixed to another location on first slide rail 202 or another area of frame door 105 such that it is configured to engage soft close mechanism 382 when outer door 102 is moved between the open position, as shown in FIG. 4, and the closed position, as shown in FIG. 1. However, it should be appreciated that according to alternative embodiments, the position of striker 380 and soft close mechanism 382 may mounted to other locations on the frame door 105 and outer door 102, respectively, such that the striker 380 is configured to engage the soft close mechanism 382 when outer door 102 is moved between the open position and the closed position. As used herein, soft close mechanism 382 is intended to refer to devices, mechanisms, or assemblies which are designed to act as a damper to slow or reduce the velocity of outer door 102 while also engaging the outer door 102 and providing assistance or force to move the outer door 102 into a fully closed position, as shown in FIG. 1.

Figure 8:
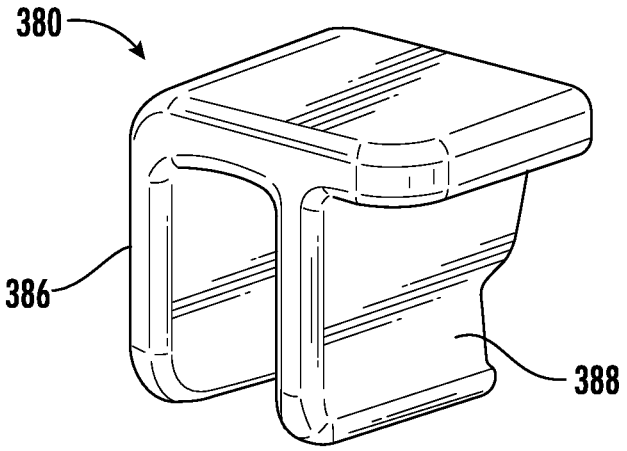
FIG. 8 provides a perspective view of a striker on the exemplary refrigerator appliance of FIG. 1.
Figure 9:
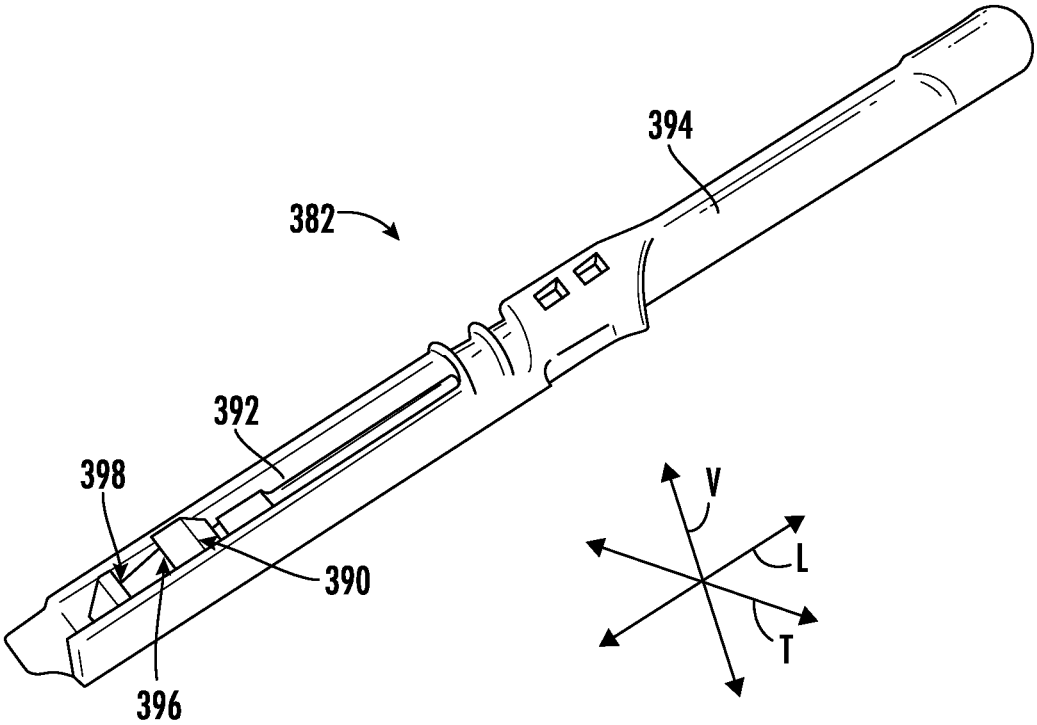
FIG. 9 depicts a soft close mechanism in an extended position for use with the exemplary refrigerator appliance of FIG. 1

Referring now specifically to FIGS. 8 and 9, the manner in which soft close mechanism 382 engages striker 380 to facilitate a soft close operation of outer door 102 will be described according to an exemplary embodiment of the present subject matter. In this regard, FIG. 8 provides a perspective view of a striker 380, which generally defines a rear face or striking face 386 and a front face or locking face 388. In addition, FIG. 9 provides a perspective view of a soft close mechanism 382, which defines a pivoting head 390 mounted on the distal end of a piston rod 392. Piston rod 392 is slidable along the lateral direction L within a cylinder assembly 394 which provides the damping and retraction forces to piston rod 392.

Thus, during operation, as outer door 102 is moved toward the closed position, striking face 388 of striker 380 impacts a first face 396 of pivoting head 390. As outer door 102 continues to move toward the closed position, pivoting head 390 pivots relative to piston rod 392 such that a second face 398 of pivoting head 390 engages locking face/rear striking face 386 of striker 380. At this point, striking face 388 and locking face 386 of striker 380 are sandwiched between first face 396 and second face 398 of pivoting head 390 such that outer door 102 moves with pivoting head 390 along the lateral direction L. Through this linkage, cylinder assembly 394 may act to damp the closing motion of outer door 102 via piston rod 392. Simultaneously, cylinder assembly 394 may draw outer door 102 into the closed position.

When a user desires to move the outer door 102 to the open position, they may pull on handle 108 of outer door 102 in the direction of the sliding axis 300 such that locking face 386 of striker 380 pulls against second face 398 of pivoting head 390 and extends piston rod 392 within cylinder assembly 394. After piston rod 392 has reached its full extension, the force of locking face 386 against second face 398 forces pivoting head 390 to pivot away from and release striker 380 altogether. Piston rod 392 may be configured for remaining in the extended position until a subsequent closing process of outer door 102. It should be appreciated that the soft close mechanism described is only exemplary and that other soft close mechanisms may be used according to alternative embodiments.

Advantageously, to open outer door 102 only to access a front portion of frame door, a user may only be required to pull handle 108 in the direction of sliding axis 300 without having to activate a latch, switch, lock, or lever. Additionally or alternatively, to open frame door 105 to access food storage chamber 100, the user may only be required to pull handle 108 in the transverse direction T without having to activate a latch, switch, lock, or lever. Accordingly, fewer moving parts and complex are required to function properly, leading to reduced maintenance and potential for failure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door assembly for an appliance, the appliance comprising a cabinet defining a cavity, the door assembly comprising:

a frame door defining a vertical direction, a lateral direction, and a transverse direction, the frame door being attached to the cabinet and movable between an open position and a closed position to permit selective access to the cavity;

an outer door slidably connected to the frame door, the outer door being slidable relative to the frame door between an open position and a closed position; and a slide assembly connecting the outer door to the frame door, wherein the slide assembly is arranged at an angle with respect to the lateral direction and the transverse direction such that when the outer door is slid between the closed position and the open position, the outer door translates in the lateral direction and the transverse direction, and wherein the slide assembly comprises a first slide rail extending from the frame door, and a second slide rail extending from the outer door and in sliding communication with the first slide rail.

2. The door assembly of claim 1, wherein the angle of the slide assembly is between 10 and 15 degrees with respect to the lateral direction.

3. The door assembly of claim 1, wherein the slide assembly is an upper slide assembly disposed at a top end of the frame door, and wherein the door assembly further comprises a lower slide assembly, the lower slide assembly comprising:

a first slide rail connected to the frame door; and a second slide rail connected to the outer door and in sliding communication with the first slide rail.

4. The door assembly of claim 1, wherein the slide assembly further comprises:

a soft close mechanism mounted to the first slide rail; and a striker mounted to the second slide rail, the striker being configured to engage the soft close mechanism when the outer door is moved toward the closed position.

5. The door assembly of claim 1, wherein the slide assembly further comprises a third slide rail slidably connected between the first slide rail and the second slide rail.

6. The door assembly of claim 1, wherein the frame door is rotatably attached to the cabinet.

7. The door assembly of claim 6, wherein the frame door comprises a first frame door rotatably connected to a first side of the cabinet; and a second frame door rotatably connected to a second side of the cabinet, and wherein the outer door comprises a first outer door slidably connected to the first frame door; and a second outer door slidably connected to the second frame door.

8. The door assembly of claim 7, wherein the first outer door is configured to slide in a first direction with respect to the first frame door and the second outer door is configured to slide in a second direction with respect to the second frame door, the second direction being different from the first direction.

9. A refrigerator appliance defining a vertical direction, a lateral direction, and a transverse direction, the refrigerator appliance comprising:

a cabinet defining a cavity; and a door assembly movably coupled to the cabinet, the door assembly comprising:

a frame door attached to the cabinet, the frame door being movable between an open position and a closed position to permit selective access to the cavity;

an outer door slidably connected to the frame door, the outer door being slidable between an open position and a closed position; and a slide assembly connecting the outer door to the frame door, wherein the slide assembly comprises a first slide rail connected to the frame door, a second slide rail connected to the outer door and in sliding communication with the first slide rail, and a third slide rail slidably connected between the first slide rail and the second slide rail.

10. The refrigerator appliance of claim 9, wherein the slide assembly is arranged at an angle with respect to the lateral direction and the transverse direction such that when the outer door is slid between the closed position and the open position, the outer door translates in the lateral direction and the transverse direction.

11. The refrigerator appliance of claim 10, wherein the angle of the slide assembly is between 10 and 15 degrees with respect to the lateral direction.

12. The refrigerator appliance of claim 9, wherein the slide assembly is an upper slide assembly disposed at a top end of the frame door, and wherein the door assembly further comprises a lower slide assembly, the lower slide assembly comprising:

a first slide rail connected to the frame door; and a second slide rail connected to the outer door and in sliding communication with the first slide rail.

13. The refrigerator appliance of claim 9, wherein the slide assembly further comprises:

a soft close mechanism mounted to the first slide rail; and a striker mounted to the second slide rail, the striker being configured to engage the soft close mechanism when the outer door is moved toward the closed position.

14. The refrigerator appliance of claim 9, wherein the frame door is rotatably attached to the cabinet.

15. The refrigerator appliance of claim 14, wherein the frame door comprises a first frame door rotatably connected to a first side of the cabinet; and a second frame door rotatably connected to a second side of the cabinet, and wherein the outer door comprises a first outer door slidably connected to the first frame door; and a second outer door slidably connected to the second frame door.

16. The refrigerator appliance of claim 15, wherein the first outer door is configured to slide in a first direction with respect to the first frame door and the second outer door is configured to slide in a second direction with respect to the second frame door, the second direction being different from the first direction.

17. A door assembly for an appliance, the appliance comprising a cabinet defining a cavity, the door assembly comprising:

a frame door defining a vertical direction, a lateral direction, and a transverse direction, the frame door being attached to the cabinet and movable about a pivot axis between an open position and a closed position to permit selective access to the cavity;

an outer door slidably connected to the frame door, the outer door being slidable relative to the frame door between an open position and a closed position; and a hinge assembly connecting the outer door to the frame door, wherein the hinge assembly comprises an interior lateral rail extending between the frame door and the outer door distal to the pivot axis, and an exterior lateral rail extending between the frame door and the outer door proximal to the pivot axis.

* * * * *